US005583779A

United States Patent [19]

Naclerio et al.

[11] Patent Number: 5,583,779

[45] Date of Patent: Dec. 10, 1996

[54] METHOD FOR PREVENTING MONITORING OF DATA REMOTELY SENT FROM A METERING ACCOUNTING VAULT TO DIGITAL PRINTER

[75] Inventors: Edward J. Naclerio, Madison; Frank D. Ramirez, Stamford, both of Conn.

[73] Assignee: Pitney Bowes Inc., Stamford, Conn.

[21] Appl. No.: 362,371

[22] Filed: Dec. 22, 1994

[51] Int. Cl.[6] ..... G07B 17/00

[52] U.S. Cl. ..... 364/464.02

[58] Field of Search ..... 235/375; 364/464.02, 364/464.03; 380/21, 51, 55

[56] References Cited

U.S. PATENT DOCUMENTS

| | | | |
|---|---|---|---|
| 4,253,158 | 2/1981 | McFiggans | 364/464.02 X |
| 4,641,347 | 2/1987 | Clark et al. | 380/51 X |
| 4,813,912 | 3/1989 | Chickneas et al. | 364/464.02 |
| 4,837,701 | 6/1989 | Sanaone et al. | 364/464.03 |
| 4,858,138 | 8/1989 | Talmadge | 364/464.02 |
| 4,888,803 | 12/1989 | Pastor | 380/51 |
| 5,142,577 | 8/1992 | Pastor | 380/21 |
| 5,535,279 | 7/1996 | Seestrom | 380/51 X |

*Primary Examiner*—Edward R. Cosimano

*Attorney, Agent, or Firm*—Angelo N. Chaclas; Charles G. Parks, Jr.; Melvin J. Scolnick

[57] ABSTRACT

The method for preventing monitoring of postage indicia data which is sent from a postage metering vault to a remotely located digital printer over a communication link between the meter vault and the digital printer. The meter is provided with an encryption engine for encrypting postage indicia data utilizing a encryption key. The digital printer includes a decryption engine for decrypting postage data received from said meter utilizing the same encryption key and then prints a postage indicia pursuant to the decrypted postage indicia data. The postage meter also includes a key manager for generating a new encryption key pursuant to a token which is either randomly generated or generated pursuant to an algorithm by a similar encryption key manager located in the digital printer which token is also used to generate the decryption key for the decryption engine. As a result, the encryption keys are the same.

5 Claims, 2 Drawing Sheets

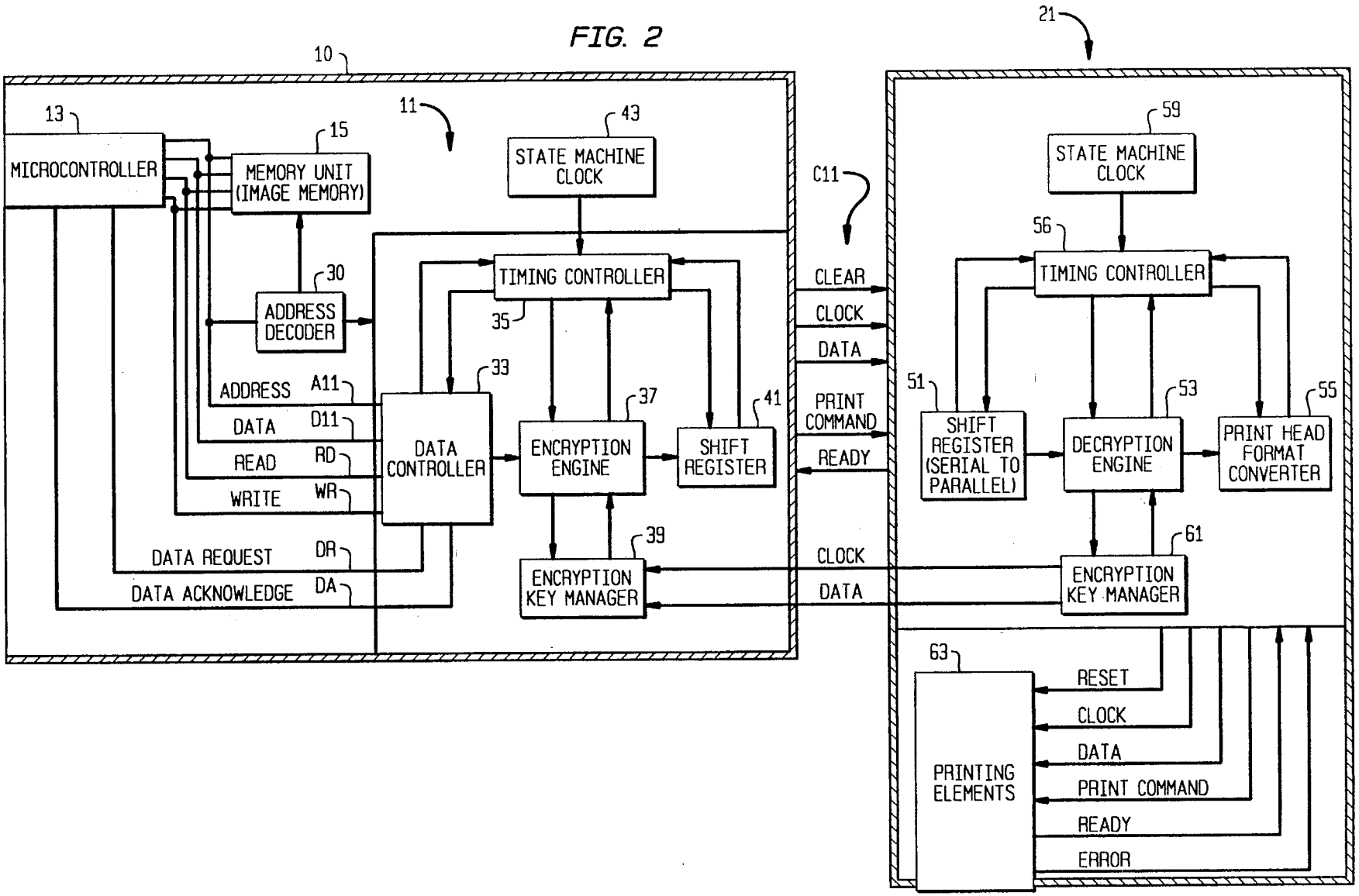
FIG. 2
10
11
13
MICROCONTROLLER
15
MEMORY UNIT (IMAGE MEMORY)
30
ADDRESS DECODER
ADDRESS
A11
DATA
D11
READ
RD
WRITE
WR
DATA REQUEST
DR
DATA ACKNOWLEDGE
DA
43
STATE MACHINE CLOCK
TIMING CONTROLLER
35
33
DATA CONTROLLER
37
ENCRYPTION ENGINE
39
ENCRYPTION KEY MANAGER
41
SHIFT REGISTER
C11
CLEAR
CLOCK
DATA
PRINT COMMAND
READY
CLOCK
DATA
21
59
STATE MACHINE CLOCK
56
TIMING CONTROLLER
51
SHIFT REGISTER (SERIAL TO PARALLEL)
53
DECRYPTION ENGINE
55
PRINT HEAD FORMAT CONVERTER
61
ENCRYPTION KEY MANAGER
RESET
CLOCK
DATA
PRINT COMMAND
READY
ERROR
63
PRINTING ELEMENTS

METHOD FOR PREVENTING MONITORING OF DATA REMOTELY SENT FROM A METERING ACCOUNTING VAULT TO DIGITAL PRINTER

BACKGROUND OF THE INVENTION

The present invention relates to a postage metering system using digital printing.

A conventional postage meter is comprised of a vault and impact printing mechanism housed in a secure housing having tamper detection. The printing mechanism is specifically designed to provide a physical barrier preventing unauthorized access to the printing mechanism except during the posting process. It is now known to use postage meters employing digital printing techniques. In such systems, the vault and digital printer remain secure within the secure housing.

It is also known to employ a postage meter in combination with an inserting system for the processing of a mail stream. It has been determined that it would be beneficial to configure a postage metering system which is configured to employ an inserter and digital printer in combination with a remotely located vault. Such a configuration, however, exposes the digital printer system to tampering, that is, the accounting and printer control apparatus are remotely and are electrically interconnected to a print head. Data exchanged between the two devices is subject to interception and possible tampering since the electrical interconnects are not physically secure.

SUMMARY OF THE INVENTION

It is an object of the present invention to present a method of providing a secure data transfer between a vault and a remotely located digital printer.

It is a further objective of the present invention to prevent a method of recording and later replaying the data representing the postage indicia image.

The metering system includes a meter in bus communication with a digital printer for enabling the meter to be remotely located from the digital printer. The meter includes a vault which is comprised of a micro controller in bus communication with an application specific integrated circuit (ASIC) and a plurality of memory units secured in a tamper resistant housing. The ASIC includes a plurality of control modules, one of which is a printer controller module and another of which is a encryption module. The digital printer includes a decoder ASIC sealed to the print head of the digital printer which communicates to the printer controller module via a printer bus. Communication between the printer controller and the print head decoder interface is accomplished through a printer bus which communications are encrypted by any suitable known technique, for example, a data encryption standard DES algorithm. By encrypting the output of the printer controller module along the printer bus any unauthorized probing of the output of the printer controller to acquire and store the signals used to produce a valid postage print are prevented. If the electrical signals are probed, the data can not easily be reconstructed into an indicia image by virtue of the encryption. The print head decoder consists of a custom integrated circuit located in proximity to the printing elements. It receives the output from the printer controller, decrypts the data, and reformats the data as necessary for application to the printing elements.

The printer controller and print head controller contain encryption key manager functional units. The encryption key manager is used to periodically change the encryption key used to send print data to the print head. The actual keys are not sent over the interface, rather, a token representing a specific key is passed. The key can be updated every time the printer controller clears the print head decoder, after a particular number of print cycles, or after a particular number of state machine clock cycles. By increasing the number of encryption keys, the probability that the system will be compromised diminishes.

BRIEF DESCRIPTION OF THE DRAWINGS

FIG. 2 is a diagrammatic representation of the postage meter micro control and printer micro control systems in accordance with the present invention.

DETAILED DESCRIPTION OF THE PREFERRED EMBODIMENT

Figure 1:
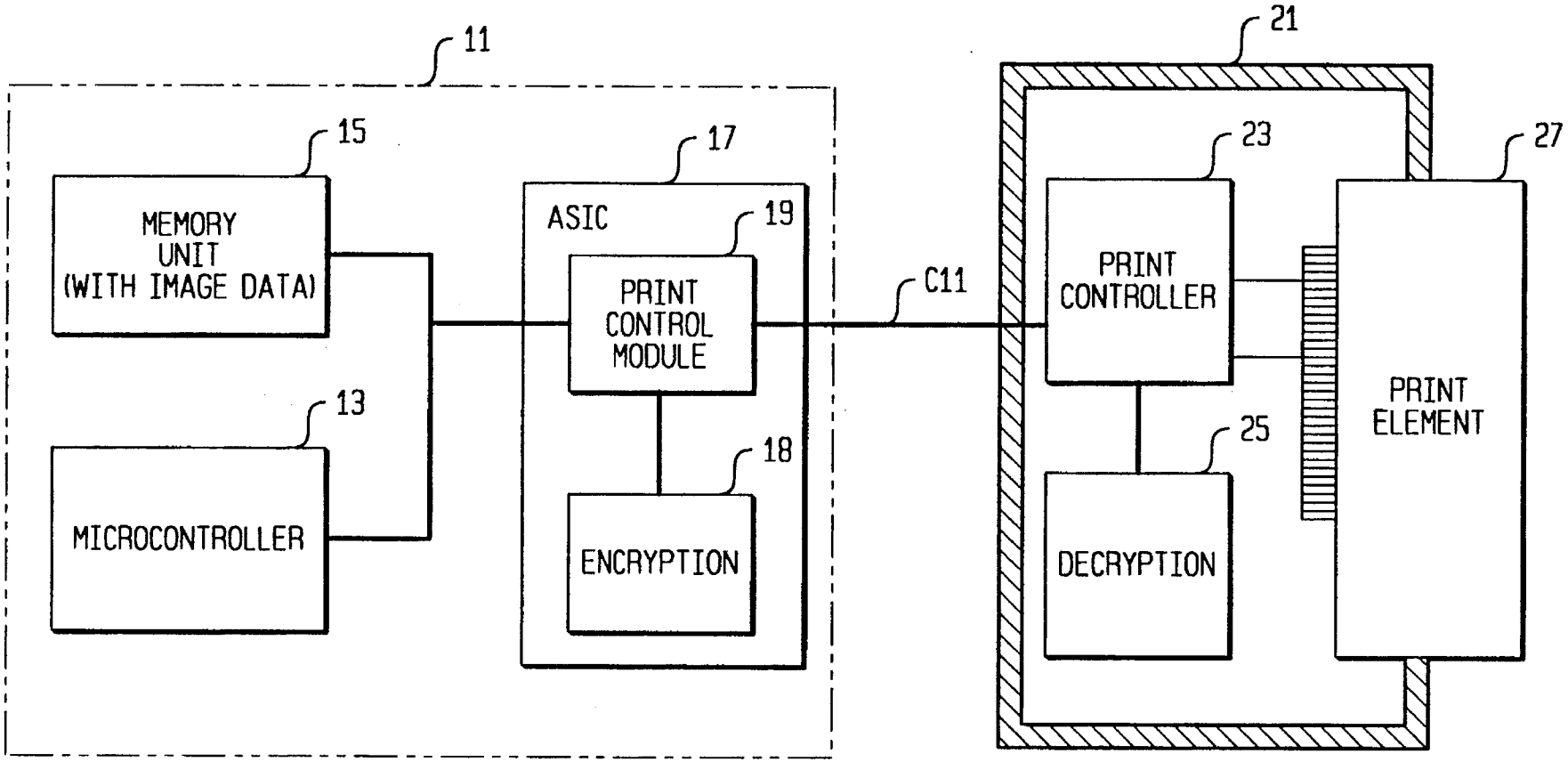
FIG. 1 is a diagrammatic representation of a postage meter in combination with a remote printing mechanism in accordance with the present invention.

Referring to FIG. 1, the postage meter control system 11 is comprised of a micro controller 13 in bus communication with a memory unit 15 and ASIC 17. The printing mechanism 21 is generally comprised of a print controller 23 which controls the operation of a plurality of print elements 27. Data is communicated between the meter control system 11 and the print mechanism over a bus C11. Generally, print data is first encrypted by an encryption module 18 and presented to the printer controller 23 through a printer controller module 19 of the ASIC 17. The data received by the print controller 23 is decrypted by a decryption module 25 in the print mechanism 21 after which the print controller 23 drives the print elements 27 in accordance with the received data. The data exchanged between the two devices is subject to interception and possible tampering since the electrical interconnects are not physically secure. Utilizing encryption to electrically secure the interface between the printer controller and print head reduces the ability of an external intrusion of data to the print mechanism 21 to drive unaccounted for posting by the printing mechanism 21. If the electrical signals are probed, the data can not easily be reconstructed into an indicia image by virtue of the encryption. The print head mechanism consists of a custom integrated circuit ASIC, more particularly described subsequently, located in proximity to the printing elements to allow physical security such as by epoxy sealing of the ASIC to the print head substrate utilizing any suitable known process.

Referring to FIG. 2, the meter control system 11 is secured within a secure housing 10. More specifically, a micro controller 13 electrically communicates with an address bus A11, a data bus D11, a read control line RD, a write control line WR, a data request control line DR and a data acknowledge control line DA. The memory unit 15 is also in electrical communication with the bus A11 and D11, and control lines RD and WR. An address decoder module 30 electrically communicates with the address bus A11. The output from the address decoder 30 is directed to a data controller 3, timing controller 35, encryption engine 37, encryption key manager 39 and shift register 41. The output of the address controller 30 operates in a conventional manner to enable and disable the data controller 33, timing controller 35, encryption engine 37, encryption key manager 39 and shift register 41 in response to a respective address generated by the micro controller 13.

The data controller 33 electrically communicates with the address bus and data bus A11 and D11, respectively, and also with the read and write control lines RD and WR, respectively. In addition, the data controller 33 electrically communicates with the data request DR and data acknowledge DA control lines. The output from the data controller 33 is directed to an encryption engine 37 where the output data from the data controller 33 is encrypted using any one of several known encryption techniques, for example, the DES encryption algorithm. The output from the encryption engine 37 is directed to the shift register 41. The timing controller 35 electrically communicates with the data controller 33, the encryption engine 37 and shift register 41 for providing synchronized timing signals to the data controller 33, the encryption engine 37 and shift register 41. The timing controller 35 receives an input clock signal from a state machine clock 43. In the most preferred configuration, a encryption key manager 39 is in electrical communication with the encryption engine 37 for the purposes of providing added system security in a manner subsequently described.

The printer mechanism 21 control ASIC includes a shift register 51, decryption engine 53 and a print head format converter 55. The output from the shift register 51 is directed to the input of the decryption engine 53. The output of the decryption engine 53 is directed to the print head format converter 55. The timing controller 56 electrically communicates with the shift register 51, decryption engine 53, a print head format converter 55 for providing synchronized timing signals to the data controller 33, the encryption engine 37 and shift register 41. The timing controller 56 receives a input clock signal from a state machine clock 59. In the most preferred configuration, a encryption key manager 61 is in electrical communication with the encryption engine 37 for the purposes of providing added system security and communicating with the encryption key manager 39 of the meter 10. The printer control ASIC electronically communicates with the print elements 63.

In operation, the meter which contains the accounting vault is remotely located from the printer 21. Upon initiation of a print cycle, the micro controller 13 generates a command to the data controller 33 to begin transferring the image to the encryption engine 37. For each location in the memory unit 15 which represents the indicia image, the data controller 33 asserts the Data Request DR signal. This causes the micro controller 13 to relinquish control of the Address Bus A 11, Data Bus D11, Read Signal RD, and Write Signal WR to the data controller 33. The micro controller indicates it has relinquished these resources by asserting the Data Acknowledge Signal DA. The data controller 33 then generates a read bus cycle by properly asserting A11, RD, and WR. In response, the address decoder 30 generates the enable signals for the memory unit 15, thus causing the memory unit 15 to output the image data on the Data Bus D11. The data is input to the data controller 33 which reformats the image data into 64-bit data messages and passes the 64-bit data messages to the encryption engine 37. The encryption engine 37 then encrypts the data using any suitable encryption algorithm and the encryption key supplied by the encryption key manager 39. The encrypted data is then passed to the shift register 41 for serial communication of the encrypted data to the printer 21. The operation of the data controller 33, encryption engine 37 and shift register 41 is synchronized by the timing controller 35 which receives a clocking signal from the state machine clock 43.

Over a communication bus C11, the encrypted serial data output from the shift register 41 is directed to the shift register 51 of the printer 21. Also carried over the bus C11 are the appropriate clock signals for clocking the data into the shift register 51 and a print command (Print Cmmd). When the whole of the encrypted data has been transmitted, a clear signal is generated over the bus C11. The shift registers 51 of the printer 21 reformats the encrypted data back into 64-bit parallel form and transfers the 64-bit data messages to the decryption engine 53 which decrypts the data using the same key used to encrypt the data which is provided by the encryption key manager 61. The decrypted data is then received by the print format converter 55 for delivery to the print head driver which enables the appropriate printing elements. It should now be appreciated that the process described is particularly suitable for any form of digital printer, such as, ink jet or thermal. Once the printing process has been completed a ready signal is sent to the meter over the bus C11.

The function of the encryption key manager in both printer controller and print head controller is to periodically change the encryption key used to send print data to the print head. The actual keys are not sent over the interface, rather, a token representing a specific key is passed. This token may be the product of an algorithm which represents any desired compilation of the data passed between the meter and the printer over some predetermined period. The token is then sent to the encryption key manager 39 which generates an identical key based on the token. For example, the key can be updated every time the printer controller clears the print head decoder, after a particular number of print cycles, or after a particular number of state machine clock cycles. By increasing the number of encryption keys, the probability that the system will be compromised diminishes. Preferably, the selection of the encryption key is a function of the print head decoder. This is done because if one key is discovered, the print head decoder could still be made to print by instructing the decoder to use only the known (compromised) key. The print head decoder can be made to randomly select a key and force the printer controller to comply. Once the data is decrypted, it is vulnerable to monitoring or tampering. By sealing the decoder to the print head and using any suitable known tamper protection techniques, the data can be protected. Such techniques include incorporating the decoder on the same silicon substrate as the printing elements, utilizing chip-on-board and encapsulation techniques to make the signals inaccessible, constructing a hybrid circuit in which the decoder and printing elements are in the same package, utilizing the inner routing layers of a multi-layer circuit board to isolate the critical signals from unwanted monitoring, and fiber optic or opto-isolation means.

The provided description illustrates the preferred embodiment of the present invention and should not be viewed as limiting. The full scope of the invention is defined by the appendix claims.

What is claimed is:

1. A method for preventing monitoring of postage indicia data sent from a postage metering vault to a remotely located digital printer over a communication link between the meter vault and the digital printer comprising the steps of:

providing said meter with means for encrypting data utilizing a encryption key;

providing said digital printer with means for decrypting postage data received from said meter utilizing said encryption key;

encrypting said postage indicia data;

transmitting said encrypted postage indicia data to said digital printer;

decrypting of said postage indicia data by said decrypting means;

printing of a postage indicia by said digital printer pursuant to said decrypted postage indicia data.

2. A method for preventing monitoring of postage indicia data sent from a postage metering vault to a remotely located digital printer over a communication link between the meter vault and the digital printer as claimed in claim 1, further comprising the steps of:

providing said postage metering vault with a encryption key manager for generating and encryption key pursuant to a token;

providing said digital printer with means of generating said token;

communicating said token to said postage meter vault;

generating a encryption key by said encryption key manager in said postage meter vault pursuant to said token such that said encryption key of both of said encryption key managers are identical.

3. A postage metering system having a postage meter remote from a digital printer use to print said postage indicia, comprising:

said postage meter having means for generating data representative of a postage indicia and having encryption means for encrypting said data representative of a postage indicia pursuant to a encryption key;

said digital printer having means for decrypting said data representative of a postage indicia and printing a postage indicia pursuant to said decrypted data;

communication means for communication of said encrypted postage indicia to said digital printer.

4. A postage metering system having a postage meter remote from a digital printer use to print said postage indicia as claimed in claim 3, further comprising:

said postage meter having a encryption key manager means for generating an encryption key in response to a token;

said digital printer having a encryption key manager means for generating a new encryption key, when desired, as a function of said decrypted data, and generating said token as a function of said decrypted data;

communication means for electronically communicating said token to said postage meter encryption key manager.

5. A postage metering system having a postage meter remote from a digital printer use to print said postage indicia as claimed in claim 3, further comprising:

said postage meter having a encryption key manager means for generating an encryption key in response to a token;

said digital printer having a encryption key manager means for generating a new encryption key, when desired, as a function of a randomly generated token;

communication means for electronically communicating said token to said postage meter encryption key manager.

* * * * *